United States Patent [19]

Vukmanic

[11] Patent Number: 4,677,802

[45] Date of Patent: Jul. 7, 1987

[54] SUSPENDED CEILING SYSTEM AND RUNNER

[75] Inventor: Ronald W. Vukmanic, Naperville, Ill.

[73] Assignee: Chicago Metallic Corporation, Chicago, Ill.

[21] Appl. No.: 837,370

[22] Filed: Mar. 7, 1986

[51] Int. Cl.[4] ..... E04B 5/52

[52] U.S. Cl. ..... 52/488; 52/664; 52/667

[58] Field of Search ..... 52/232, 593, 484, 664, 52/667, 488

[56] References Cited

U.S. PATENT DOCUMENTS

| | | | |
|---|---|---|---|
| 4,034,531 | 7/1977 | Balinski | 52/484 |
| 4,434,599 | 3/1984 | McCall | 52/484 |
| 4,470,239 | 9/1984 | Sauer | 52/667 |
| 4,489,529 | 12/1984 | Ollinger et al. | 52/484 |
| 4,505,083 | 3/1985 | Mieyal | 52/484 |
| 4,525,973 | 7/1985 | Vukmanic et al. | 52/667 |
| 4,598,514 | 7/1986 | Shirey | 52/664 |
| 4,601,153 | 7/1986 | Dunn et al. | 52/666 |

*Primary Examiner*—James L. Ridgill, Jr.

*Attorney, Agent, or Firm*—Hill, Van Santen, Steadman & Simpson

[57] ABSTRACT

A runner and a ceiling system utilizing the runner as a main runner and cross-runner characterized by each of the runners being composed of a first member and a cap member. The first member is bent to form an inverted T-bar configuration with a groove extending inwardly from the flange of the T and the cap member having the same configuration and being secured on the flange of the T-bar configuration to form a channel with flange portions on each side for supporting panels of the ceiling system.

11 Claims, 6 Drawing Figures

SUSPENDED CEILING SYSTEM AND RUNNER

BACKGROUND OF THE INVENTION

The present invention is directed to a runner and to a suspended ceiling system having many runners and cross-runners for supporting ceiling panels. Each of the runners has a substantially inverted T configuration with an upper bead connected by webs to outwardly directed flange elements which have a first flange portion connected by an offset portion to a second flange portion so as to form a downwardly opening groove. The exposed surfaces of the flange elements and the groove are covered by a cap member having a channel so that changes in the color of the flanges can be obtained by changing the cap. In addition, the system utilizing the runners has the connective joints which provide a fire-rated system because it allows for limited expansion of the cross-members when subjected to elevated temperatures.

Suspended ceiling support systems or structures, which utilize a plurality of main runners or members and cross-members or runners are shown in a number of U.S. patents. One such system is described in U.S. Pat. No. 4,525,973 and this system has an inverted T-shaped structure whose outwardly extending flat flanges are covered by a cap member which can be viewed by the occupants of a room utilizing the ceiling structure. The standard total width for the pair of flanges is approximately one inch. Instead of having a flat flange such as disclosed in the above-mentioned patent, it has been proposed for aesthetic reasons to provide the runners with a narrower flange and a narrower flange with a longitudinally extending recess. Different ways of obtaining these types of structure are disclosed in U.S. Pat. Nos. 4,034,531; 4,470,239; 4,489,529 and 4,505,083.

In the ceiling system of U.S. Pat. No. 4,034,531, a T member has a box-like member, which is provided with a longitudinally extending groove, secured thereto. The structure also requires panels which have rabbet edges so that a recess is formed at the edges of the panels for receiving this box member when the panels are supported by the runners.

In the arrangement of the structure of U.S. Pat. No. 4,470,239, the runner is formed from a single piece of metal which has a bead with two web portions extending down in an inverted V shape and terminating in outwardly extending flanges. The webs are resilient to each other so as to act to center the panels to provide proper support even though the flanges are of a substantially narrower configuration than the flange of a standard runner.

U.S. Pat. No. 4,489,924 discloses a runner with a T shape or bar configuration that has a cap member. The flange is approximately 5/16 of an inch wide and webs are held together by lances or stitches.

In U.S. Pat. No. 4,505,083, each of the runners has a bead with two webs extending downwardly and being bent to form flange elements having different configurations and a cap is applied to these flange elements so that the exposed portion observed by a person in the room having the ceiling structure will see the cap member. As illustrated, the construction can provide a shallow V-shaped groove, a rectangular groove, a groove having a trapezoidal configuration and other possible groove shapes. In addition, to provide the connections between the cross-runner and main runners, notches and tapered ends are formed. While this provides an aesthetic structure, it does have a disadvantage of greatly reducing the rigidity of the main runner particularly during installation because of the notches in the flange elements.

In addition to preparing a runner which has a new aesthetic look, it is also desirable to provide a ceiling system which is fire-rated and can allow for expansion of the cross-runners when subjected to an elevated temperature without buckling of the runners to drop the panels.

SUMMARY OF THE INVENTION

The present invention is directed to a ceiling runner and a ceiling system utilizing the runner which presents a narrow flange having a longitudinally extending recess and which ceiling system allows expansion of cross-runners due to an elevated temperature without buckling of the runners.

To accomplish these goals, the invention is directed to a suspended ceiling system comprising main runners extending parallel to each other and cross-runners extending between the main runners at spaced intervals, each of the runners being composed of a first member and a cap member, said first member having an inverted T configuration having a pair of flange elements connected by a pair of webs to a bead, each flange element having a first flange portion connected by an offset portion to a second flange extending in the same direction as the first bend and having an outer edge, said pair of flange elements defining a longitudinally extending recess or groove facing away from the bead flange portion. The cap member has a center portion connected by offset portions to flange portions to form the same configuration as the pair of flange elements and is secured to the flange elements with the center portion and each offset portion received in the groove to provide the runner with a flange arrangement with a channel. Each of the main members has an end surface of the bead and end surfaces of the first flange portions and a portion of the offset portion lying in the same plane and the second or lowermost flange portions and a portion of each offset being cut out to form a notch or recess, the web of the cross member having an integral tongue extending past the end surfaces of the flange and bead, each of the main runners having elongated slots for receiving the tongue of the cross-runner with the recess or notch receiving the second flange of the main runners and the remaining end surfaces being spaced from the offset portion of the main runner and the bead. Each of the tongues has first means cooperating with the elongated slot to hold the tongue in the slot and second means cooperating with the second means of another tongue to interconnect the two tongues together to form an end-to-end joint between cross-runners extending into the elongated slot from opposite directions, said first means being a tab bent from the tongue to form a catch surface facing away from the end of the tongue and toward the end surfaces of the bead, said notch engaging an edge of the flange of the main runner to limit movement of the tongue into the slot.

The runner enables providing a system which is fire-rated and can allow axial expansion of the cross-runners to a limited amount without buckling of the suspended ceiling system. This is due to the fact that the end of the bead is spaced from the bead of the main runner in the assembled position and during expansion, the end of the upper portion of the flange will bear against the flange of the main runner and cause a collapsing of that flange before buckling of the runner will occur.

Another advantage of the invention over the prior art is that none of the main runners require notches or mitered cuts in the flanges and therefore the rigidity of the runner is maintained and inadvertent bending during assembly will not occur. A further advantage of the present invention is that the cap member can be produced in any desired color prior to being secured to the first member of the runner and allow selecting the desired aesthetic colors for the system. Another advantage of the invention is that the total width of the flange is approximately 9/16 of an inch with the longitudinal recess or channel having a width of approximately 3/16 of an inch so that each of the lower flange portions have a width of approximately 3/16 of an inch. This enables providing a narrow strip with the groove which provides increased aesthetics to the ceiling structure.

DESCRIPTION OF THE PREFERRED EMBODIMENTS

The principles of the present invention are particularly useful in a suspended ceiling system generally indicated at 10 which comprises a plurality of main runners or members 11 and cross-members 12. As illustrated, the main runners 11 extend parallel and the cross-members extend parallel to each other and transverse to the main runners 11 to form a rectangular grid structure for supporting panels 13.

Figure 1:
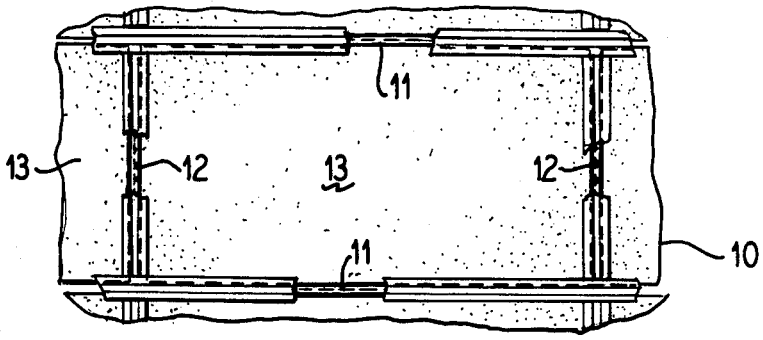
FIG. 1 is a plan view looking up from a room utilizing the ceiling structure of the present invention.

As best illustrated in FIG. 1, each of the main runners 11 is composed of a first member 14 and a cap or second member 15 which are strips of bent sheet metal. The first member 14 is bent into a generally inverted T configuration with outwardly extending flange elements 16 connected by webs 17 to an integral bead 19. Each of the flange elements 16 is formed with a first flange portion 20 connected by a right angle bend to an offset portion 21 which in turn is connected by another right angle bend in the opposite direction to a second or lower flange portion 22. Thus, the flange elements 16 have an offset configuration and form a box-type structure having a longitudinally extending recess or groove opening toward an occupant in the room having the ceiling system. The second cap member 15, which has a center portion 23 connected by two offset portions 24 to the flange portion 25, conforms to the configuration of the two flange elements 16. The cap member 15 is assembled on the member 14 with the center portion 23 and offset portion 24 received in the groove and has edges 26 which are crimped onto the outer surface of the flange portion 22 to form a channel 28 for the runner with outer flange edges 29.

The cap member 15 can be painted any desired color or provided with any desired metal finish so that by changing the cap member 15, different finishes and/or colors are present for the portion of the flange and the channel 28 which can be viewed by an occupant of the room. The channel 28, as illustrated, has a rectangular cross-section with a depth being greater than the width. It is noted that the combined flange elements 16 have an overall width of approximately 9/16 of an inch with the channel 28 having a width of approximately 3/16 of an inch. Thus, care must be taken that the panels 13 are of the desired size to fit in between the offset portions 21 and rest on the portion of the cap member 14 that overlies the second flange portion 22.

In order to form a connection, the web of the main runners 11 are provided with elongated apertures 30 which preferably have a shape such as disclosed in U.S. Pat. No. 4,525,973 and this shape is incorporated by reference thereto.

Figure 4:
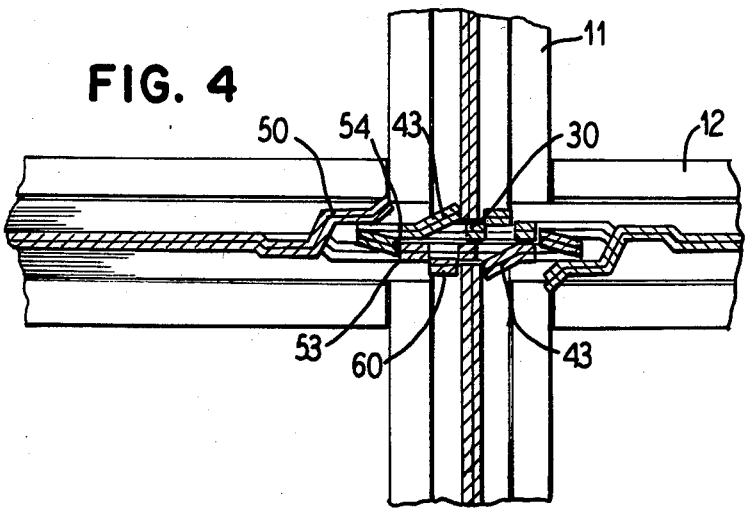
FIG. 4 is an enlarged cross-sectional view taken along lines IV—IV of FIG. 3.

Each of the cross-members or runners 12 has a cross-section the same as the member 11 and terminate at an end with an end surface 40 for both a portion of the web, a portion of the bead 18 and a portion of the flange elements 16. Extending outwardly past the end surface 40, the web 17 has an integral tongue 41 which is provided with first means for locking the tongue in the aperture 30 and second means coacting with the second means of the oppositely inserted tongue for interconnecting the two tongues together. The first means illustrated are tabs 43 which are cut out of the tongue and bent so that the edge of the tab extends away from the end of the tongue and will engage a side of the web 17 (see FIG. 4) adjacent the aperture 30. The tabs 43 are formed by two parallel extending slots 45 connected by a slicing cut 46. As illustrated, the tabs are bent toward one side.

Figure 2:
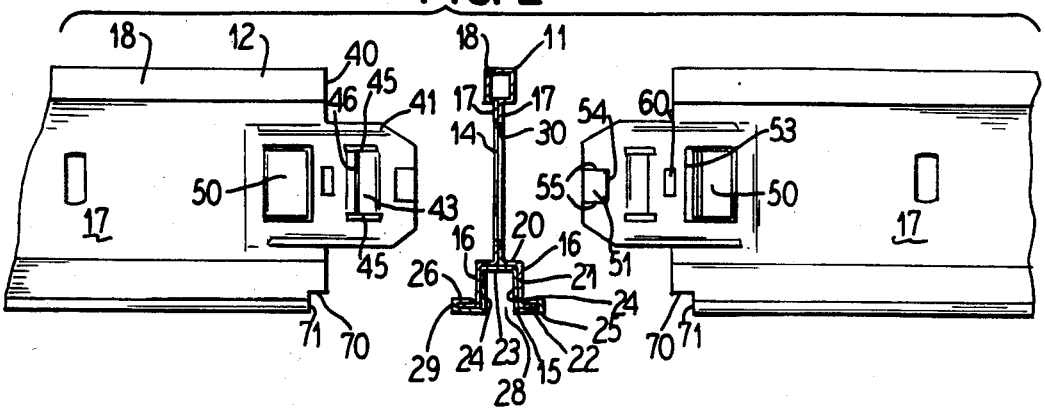
FIG. 2 is an exploded view of two cross-runners in accordance with the present invention about to be inserted into an aperture of a main runner from opposite sides.

The second means includes a flap 50 at the base of the tongue, which forms a pocket for receiving the leading end of the tongue of the runner inserted from the opposite direction (see FIG. 4) and an embossment 51 adjacent the leading end. The embossment and the tab are bent to the same side which is opposite to the side of the tabs 43 of the first means. When forming the flap 50, an abutment surface 53 is formed and this is engaged by an abutting edge 54 of the embossment 51 of the other tongue. It should be noted that as illustrated, the flap 50 has several bends and may be provided with a strengthening embossment (not illustrated). The embossment 51 is preferably formed by two bends or creases 55 as best illustrated in FIG. 2 so that the abutment surface 54 has a given flat length and is substantially planar.

The web 17 is a double thickness and the embossments such as 51 will hold the end of the tongue 41 together. To aid in holding the layers forming the tongue together, a stitch 60 is provided. The stitch basically involves a pair of closely spaced cuts with the material between the cuts deformed out of the plane of the web at least a distance of one layer and as illustrated in the present drawings the distance of almost two thicknesses or layers.

Figure 3:
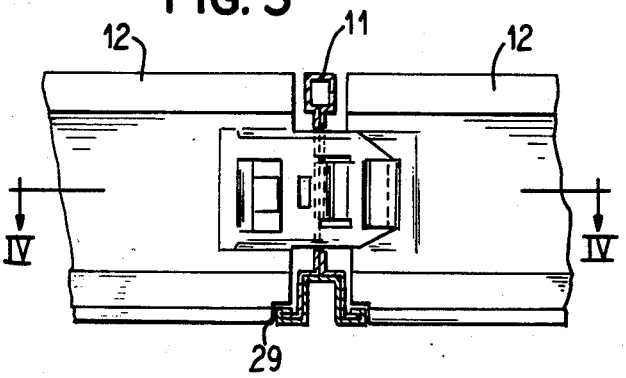
FIG. 3 shows a connection after insertion of the two cross-runners of FIG. 2.
Figure 6:
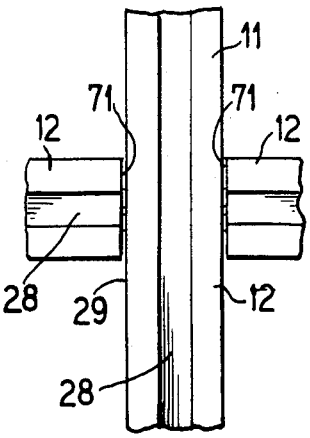
FIG. 6 is an enlarged plan view of the joint illustrated in FIGS. 3 and 4.

As previously mentioned, the bead 18 and the portion of the web other than the tongue and a portion of each of the flange elements 16 have an end surface 40 which is substantially in a vertical plane. However, the lower or second flange portion 22 and a portion of the offset 21 and the cap member 15 covering the flange portions 22 are provided with a notch 70 so that a portion of the flange elements 16 has an offset surface 71. As illustrated in FIG. 3, the notches 70 receive the second or lower flanges 22 of the main runner when the tongues 41 are inserted into their assembled connecting position. As illustrated, a slight clearance exists, however, the offset surface 71 loosely engages flange edge 29. Thus, when viewed from the bottom as illustrated in FIG. 6, a channel 28 of the main runners 11 will be constant but the channels 28 of the cross-runners or members will be terminated by the flange edge 29 of the main runner 11.

Figure 5:
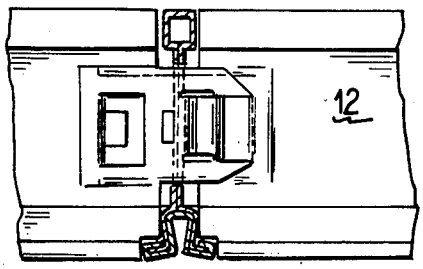
FIG. 5 is a view similar to FIG. 3 showing the connection after relieving expansion created by an elevated temperature.

Due to the spacing between the edges 71 and the end surface 40 as well as the size of the flange portions 22, an expansion of the cross-runners 12 will cause a first compressive force to be forced on the box-shaped lower flange of the main runner. With continual expansion, the pressure will cause a partial collapse of the box-shaped lower flange as illustrated in FIG. 5. Due to the positioning of the force in this region, a substantial amount of expansion can occur with yielding of the box-shaped flange prior to buckling of the members to cause a dropping or release of the panels such as 13. Thus, the system 10 will have a fire rating since it can withstand a predetermined time at a predeterined elevated temperature.

In addition to the advantages of enabling selecting the cap member 15 to change the appearance of the flanges as viewed by an observer in the room having the ceiling system 10, the runners 11 and 12 for the ceiling system have the advantage that the longer runners such as the main runners 11 do not have any notches or cuts in the flanges which would reduce their stiffness and allow undesirable lateral bending during handling of the runner. Thus, the runners of the present system have the advantage that the main runners 11 and cross-runners 12 have continuously extending flanges to maintain the rigidity both when installed and during the step of installing.

Although various minor modifications may be suggested by those versed in the art, it should be understood that I wish to embody within the scope of the patent granted hereon, all such modifications as reasonably and properly come within the scope of my contribution to the art.

I claim:

1. A suspended ceiling system comprising main runners extending parallel to each other and cross-runners extending between the main runners at spaced intervals, each of said runners being composed of a first member and a cap member, said first member having an inverted T configuration with a pair of flange elements being connected by webs to an integral bead, each of the flange elements having a first flange portion being connected by an offset portion to a second flange portion extending substantially parallel to the first flange portion, said pair of flange elements defining a longitudinally extending groove opening away from the bead, said cap member having a center portion connected to flange portions by offset portions to provide a configuration matching the configuration of the pair of flange elements, said cap member being secured to the outer edges of the second flange portions with the center portion and offset portions being received in the groove to form a flange arrangement with continuous edges for the runners with a longitudinal channel, each of the cross-runners having ends with a notch formed through the second flange portions and a part of the offset portions to provide offset surfaces for the end surfaces of the second flange portions which offset surfaces are offset from the end surfaces of the first flange portions, remaining parts of the offset portions and the webs, said webs having a tongue extending beyond the end surfaces of the bead and flange portions, each of the webs of the main runners having an elongated slot for receiving the tongues of the cross-runner with the notch receiving the continuous second flange portion of the main runner and the remaining parts of the offset portions and the first flange portions being spaced from the offset portion of the main runner, each of the tongues having first means cooperating with the elongated slot to lock the tongue in the slot with the offset surface loosely engaging the continuous edges of the second flange portions of the main runner and second means cooperating with the second means of another tongue to interconnect the two tongues together to form an end-to-end joint between cross-runners extending into the elongated slot from opposite directions, said first means being a tab bent from the tongue to form a catch surface facing away from the end of the tongue.

2. A suspended ceiling system according to claim 1, wherein the second means includes a flap formed at a base of the tongue, said flap creating a first abutment surface in the tongue, said means including means for forming a second second abutment surface adjacent the free end of the tongue with the tabs of the first means extending to a side opposite the flap and means forming the second abutment surface, and being located therebetween.

3. A suspended ceiling system according to claim 2, which includes a stitch formed in the tongue between the flap and tab to hold the layers of the tongue together.

4. A suspended ceiling system according to claim 1, wherein the first flange portion, offset portion and the second flange portion of each flange element are interconnected by a right-angle bend so that the groove and channel have a rectangular cross-section.

5. A suspended ceiling system according to claim 4, wherein the depth of the channel is greater than the width of the channel and the offset portion will bend around its right-angle bend connected to the first flange portion during initial axial expansion of the cross-runner to prevent buckling thereof.

6. A suspended ceiling system according to claim 4, wherein the width of each of the second flange portions and the width of the channel are approximately equal.

7. A suspended ceiling system accoding to claim 6, wherein each of the second flange portions is a narrow flange portion having a width of approximately 3/16 of an inch so that the entire width of the exposed portion of the runner is approximately 9/16 of an inch.

8. A suspended ceiling system according to claim 6, wherein the depth of the channel is greater than the width of the channel.

9. A cross-runner for being used in a ceiling system as a cross-runner extending between two parallel main runners, said cross-runner comprising a first member and a cap member, said first member having an inverted T configuration with a pair of flange elements being connected by webs to an integral bead, each of the flange elements having a first flange portion being connected by an offset portion to a second flange portion having an outer edge and extending substantially parallel to the first flange portion, said pair of flange elements defining a longitudinally extending groove opening away from the bead, said cap member having a center portion connected to flange portions by offset portions to provide a configuration matching the configuration of the pair of flange elements, said cap member being secured to the outer edges of the second flange portions with the center portion and offset portions received in the groove to form a flange arrangement with continuous edges for the runner with a longitudinal channel, each of the cross-runners having ends with a notch formed through the second flange portions and a part of the offset portions to form offset surfaces for the end surfaces of the second flange portions which are offset from the end surfaces of the first flange portions and remaining parts of the offset portions, said web having a tongue extending beyond end surfaces of the bead and flange portions for being received in an elongated slot in the web of the main runner, said tongue having first means cooperating with the elongated slot to lock the tongue in the slot with the notches receiving the second flanges of the main runner and the offset surfaces of the second flange portions of the cross-runner loosely engaging a continuous edge of the second flange portion of the main runner, and said tongue having second means cooperating with the second means of another tongue to interconnect the two tongues together to form an end-to-end joint between cross-runners extending into the elongated slot from opposite directions.

10. A cross-runner according to claim 9, wherein the first and second flange portions extend parallel to each other and are interconnected by right-angle bends to the offset portion of each flange element so that the channel has a rectangular cross-section.

11. A cross-runner according to claim 10, wherein the width of each of the second flange portions and the channel are approximately equal.

* * * * *